US008226422B2

(12) United States Patent
Towashiraporn et al.

(10) Patent No.: US 8,226,422 B2
(45) Date of Patent: Jul. 24, 2012

(54) RESILIENT PLUG CONNECTOR

(75) Inventors: Pongpinit Towashiraporn, Vernon Hills, IL (US); Paul B. Crosbie, Grayslake, IL (US); Gaurav Gupta, Lake Bluff, IL (US); Maninder S. Sehmbey, Hoffman Estates, IL (US); Michael F. Spence, Libertyville, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 0 days.

(21) Appl. No.: 12/975,676

(22) Filed: Dec. 22, 2010

(65) Prior Publication Data

US 2012/0164876 A1 Jun. 28, 2012

(51) Int. Cl.
*H01R 12/00* (2006.01)

(52) U.S. Cl. ..... 439/83

(58) Field of Classification Search ..... 439/79, 439/80, 947, 571
See application file for complete search history.

(56) References Cited

U.S. PATENT DOCUMENTS

| | | | | |
|---|---|---|---|---|
| 6,022,244 | A * | 2/2000 | Chiu | 439/570 |
| 6,328,600 | B1 * | 12/2001 | Fujiki et al. | 439/570 |
| 7,740,511 | B2 | 6/2010 | Katano | |
| 7,963,798 | B1 * | 6/2011 | Yang | 439/567 |

* cited by examiner

*Primary Examiner* — Phuong Dinh
(74) *Attorney, Agent, or Firm* — Gary J. Cunningham

(57) ABSTRACT

An improved plug connector (100) is disclosed. It includes: a generally U-shaped contact (102) including a first vertical leg (104), a second vertical leg (106) and a horizontal leg (108) connecting the first vertical leg (104)and the second vertical leg (106), the first vertical leg (104) being longer than the second vertical leg (106); and a retention block 110 connected to both sides (112) and (114) of the horizontal leg (108) configured to support the U-shaped contact (102).This design can stand up to the harsh environment that it will be exposed to and will provide improved resistance to failure.

19 Claims, 8 Drawing Sheets

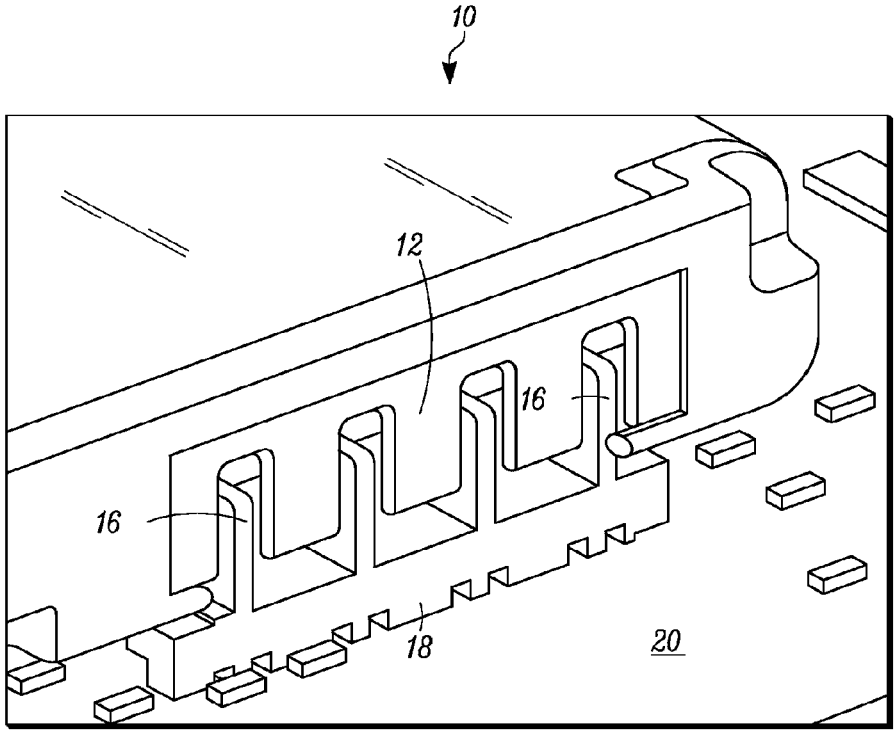
FIG. 1 -PRIOR ART-
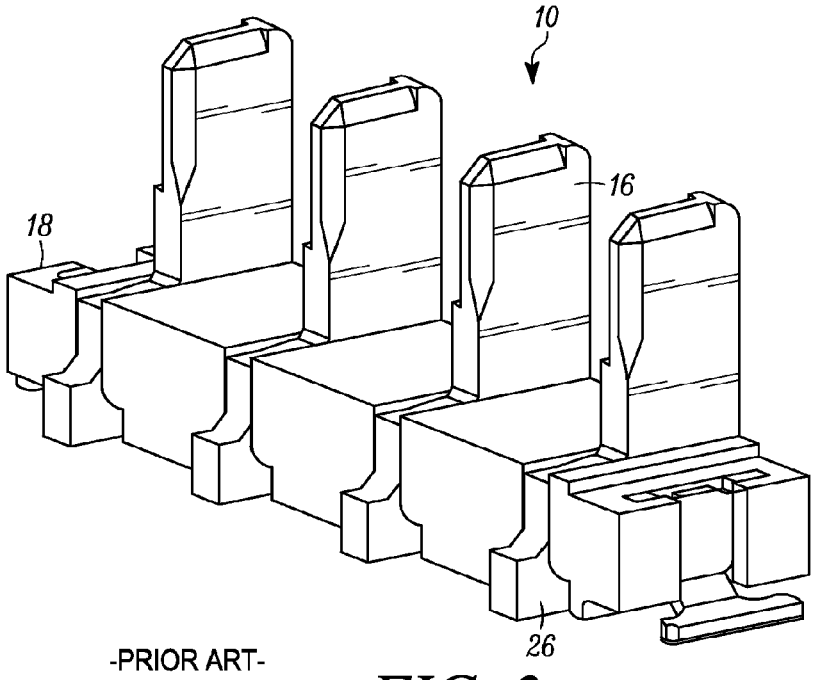
-PRIOR ART-
FIG. 2

-PRIOR ART-

FIG. 4 -PRIOR ART-

RESILIENT PLUG CONNECTOR

BACKGROUND OF THE INVENTION

1. Field of the Disclosure

The disclosure relates in general to electrical connectors, and more particularly, to an improved resilient plug connector for use in connection with electronic devices.

2. Background Art

There is a significant market for portable mobile electronic devices that are light weight, are battery operated and are durable to withstand the harsh environment they will be exposed to, such as dropping. Many have tried to provide durable housings and electrical connectors for such devices, but have failed. Electronic products with durable connectors would be considered an improvement in the art and would provide a solution plaguing the industry.

Further, electrical connectors that can be easily assembled, disassembled, connected and disconnected to electronic devices, circuit boards and the like, at the factory or in the field, would be considered an improvement in the art.

Traditional known battery interconnection systems employ a leaf spring design and can suffer from a battery bounce during low and high impact conditions (i.e. 10-50 cm phone drop or more). For example, when an electronic device encounters quick movements and/or deformation of the structure, a battery can move away from a contact surface of a connector, which results in losing electrical connection causing the phone to power cycle itself.

A prior art battery interconnection system 10 is shown in FIGS. 1-4, utilizing an L-shaped blade connector 16 with a mating connector mounted on a PCB. However, the prior art 10 has shown a high rate of failure. The design has long vertical blade connectors 16 (FIG. 2) that engage with a battery mating component 12, shown in FIGS. 1-3. Due to the engagement in this design, the blade connectors 16 are subjected to excessive loading during impact and are susceptible to cause failure on a printed circuit board (PCB) 20, shown at an edge portion 22 at FIG. 4. Thus, there is a need to solve this problem by providing an improved resilient plug connector that can withstand harsh environments, such as impact loads, drops, and the like.

It is therefore desirable to provide an improved resilient plug connector which overcomes the problems plaguing the industry.

BRIEF DESCRIPTION OF THE DRAWINGS

FIG. 1 is a prior art battery interconnection system 10 utilizing a blade connector 16 style with a mating component 12 mounted on a PCB 20.

FIG. 2 is a partial perspective view of the prior art battery interconnection system 10 in FIG. 1, shown with L-shaped blade connectors 16. Due to the engagement in this design, the blade connector 16 is subjected to excessive loading during impact and is susceptible to cause failure on a PCB 20 shown in FIG. 4.

DETAILED DESCRIPTION OF THE INVENTION

Figure 3:
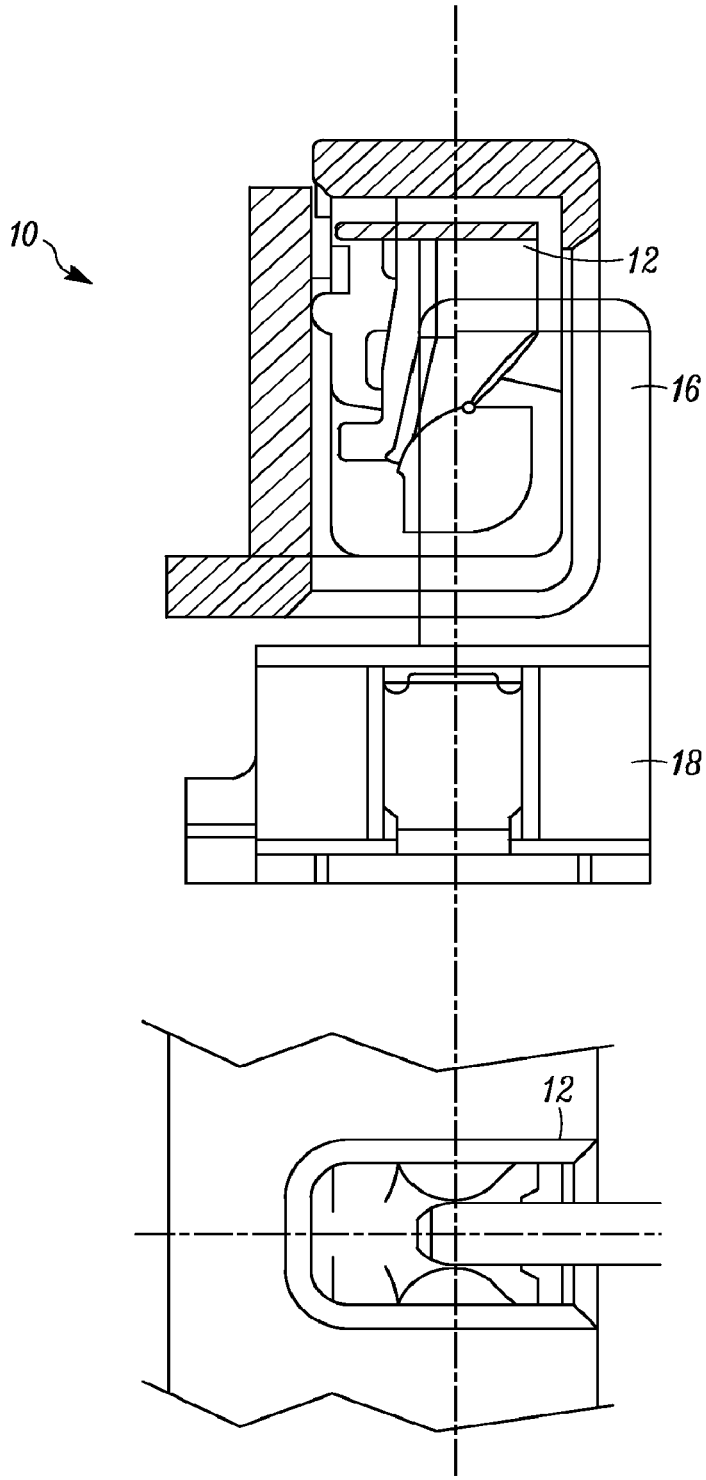
FIG. 3 includes an enlarged side view and partial top cutaway view of the prior art battery interconnection system 10, shown in FIGS. 1 and 2.

The following is a detailed description and explanation of the preferred embodiments of the invention and best modes for practicing the invention.

Referring to FIGS. 5-10, an improved resilient plug connector 100 is shown. In its simplest form, it includes: a generally U-shaped contact 102 including a first vertical leg 104, a second vertical leg 106 and a horizontal leg 108 connecting the first vertical leg 104 and the second vertical leg 106, the first vertical leg 104 being longer than the second vertical leg 106; and a retention block 110 (FIG. 9) connected to both sides 112 and 114 of the horizontal leg 108 configured to support the U-shaped contact 102.

Advantageously, the resilient plug connector 100 provides a durable and robust structure that can stand up to the harsh environment that it will be exposed to and will provide improved resistance to delamination of a printed circuit board 116 it will be connected to, as detailed below.

Figure 4:
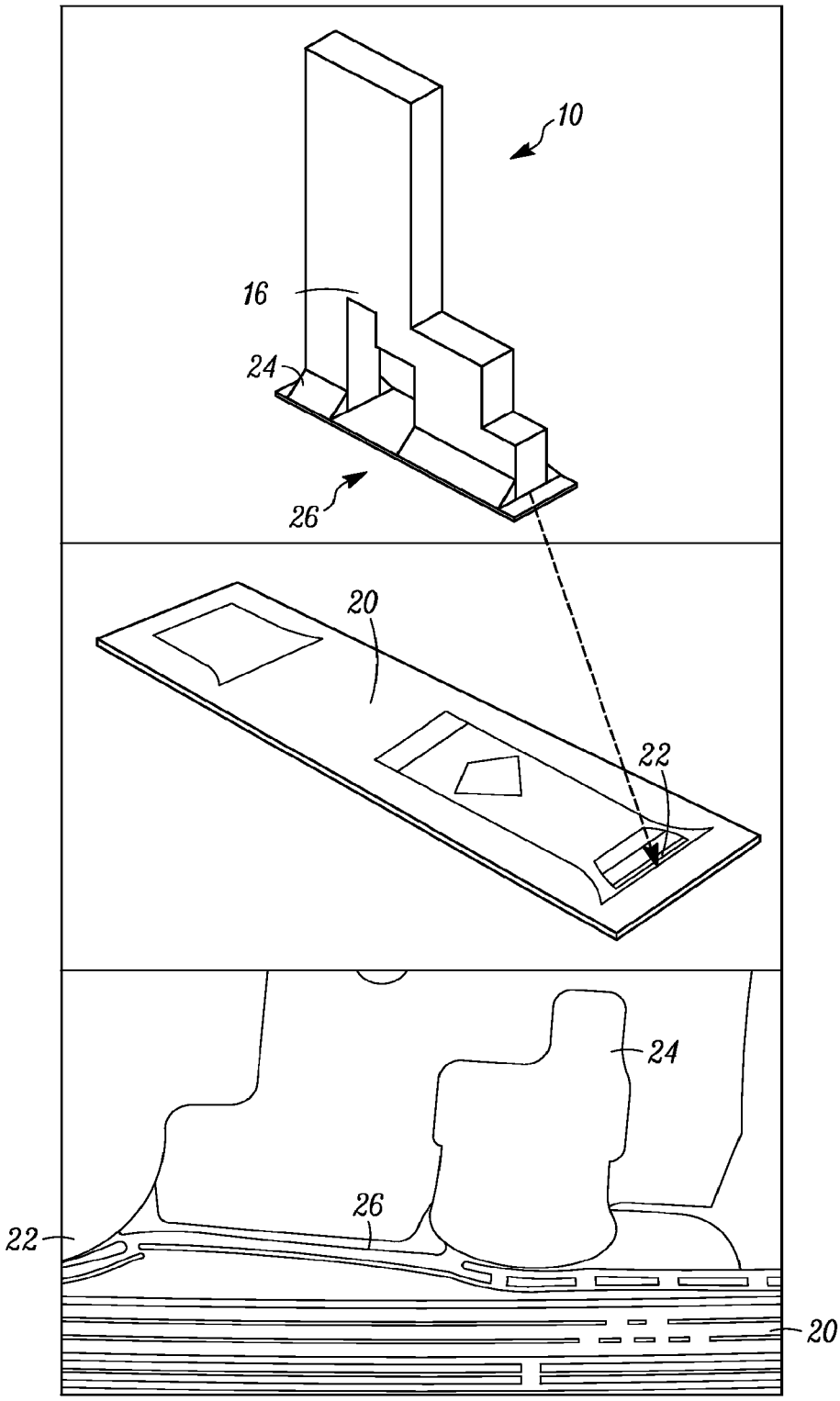
FIG. 4 is a perspective isometric view of a blade connector 16 and PCB 20, and there below an enlarged partial view of a damaged or delaminated PCB 20 at an edge 20, encountered in the prior art battery interconnection system 10 in FIGS. 1 and 2, due to the construction in this design. The blade connector 16 is subjected to excessive loading during impact and is susceptible to cause failure in the PCB 20. The blade connector 16 has a cut out 24 at a bottom 26. Thus, there is a need to solve this problem.
Figures 5, 6:
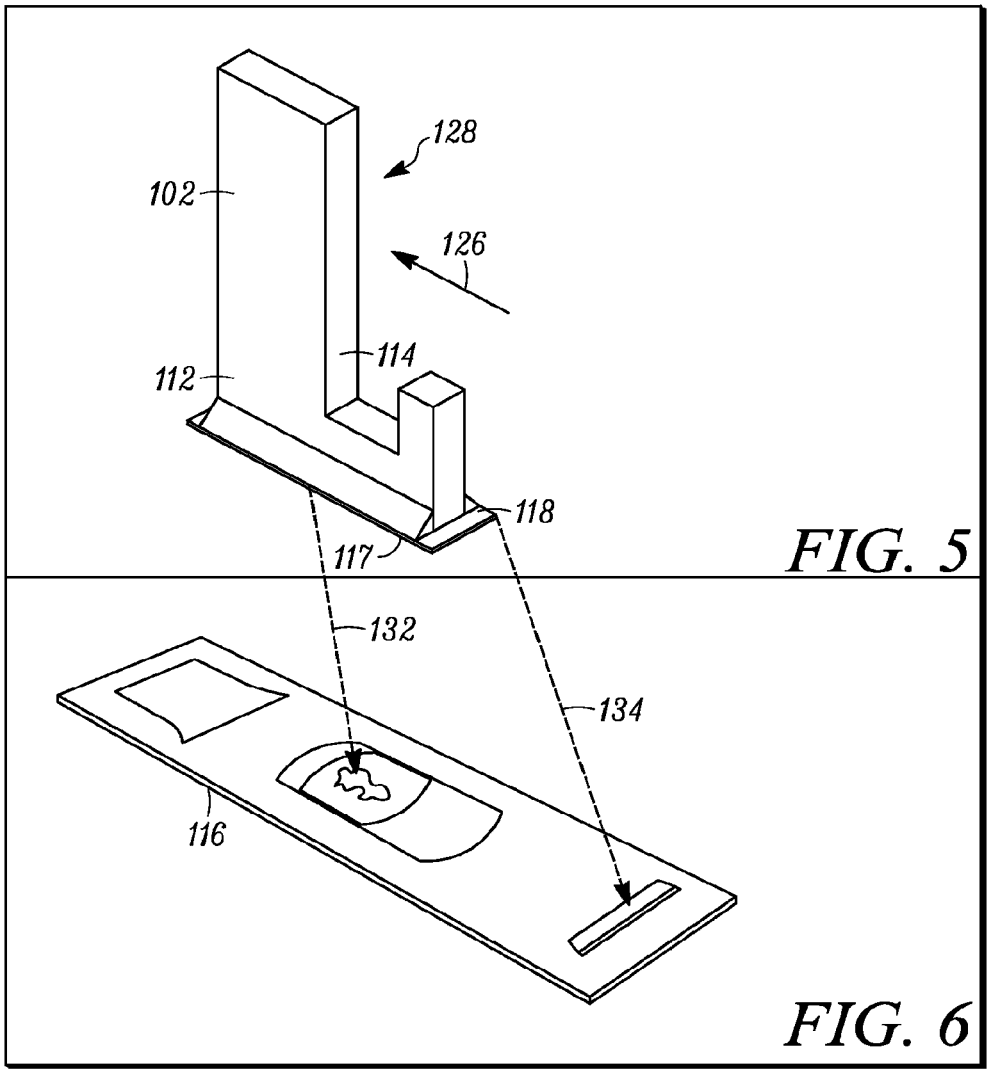
FIG. 5 is a partial perspective view of an embodiment of a resilient plug connector, showing a generally U-shaped contact 102, in accordance with principles of the present invention.
FIG. 6 is a partial perspective view of an embodiment of a resilient plug connector, showing placement of where the generally U-shaped contact 102 is solder attached to a printed circuit board 116, showing an edge 134 and center 132, in connection with simulated test results shown in the table in FIG. 10, in accordance with principles of the present invention.
Figure 10:
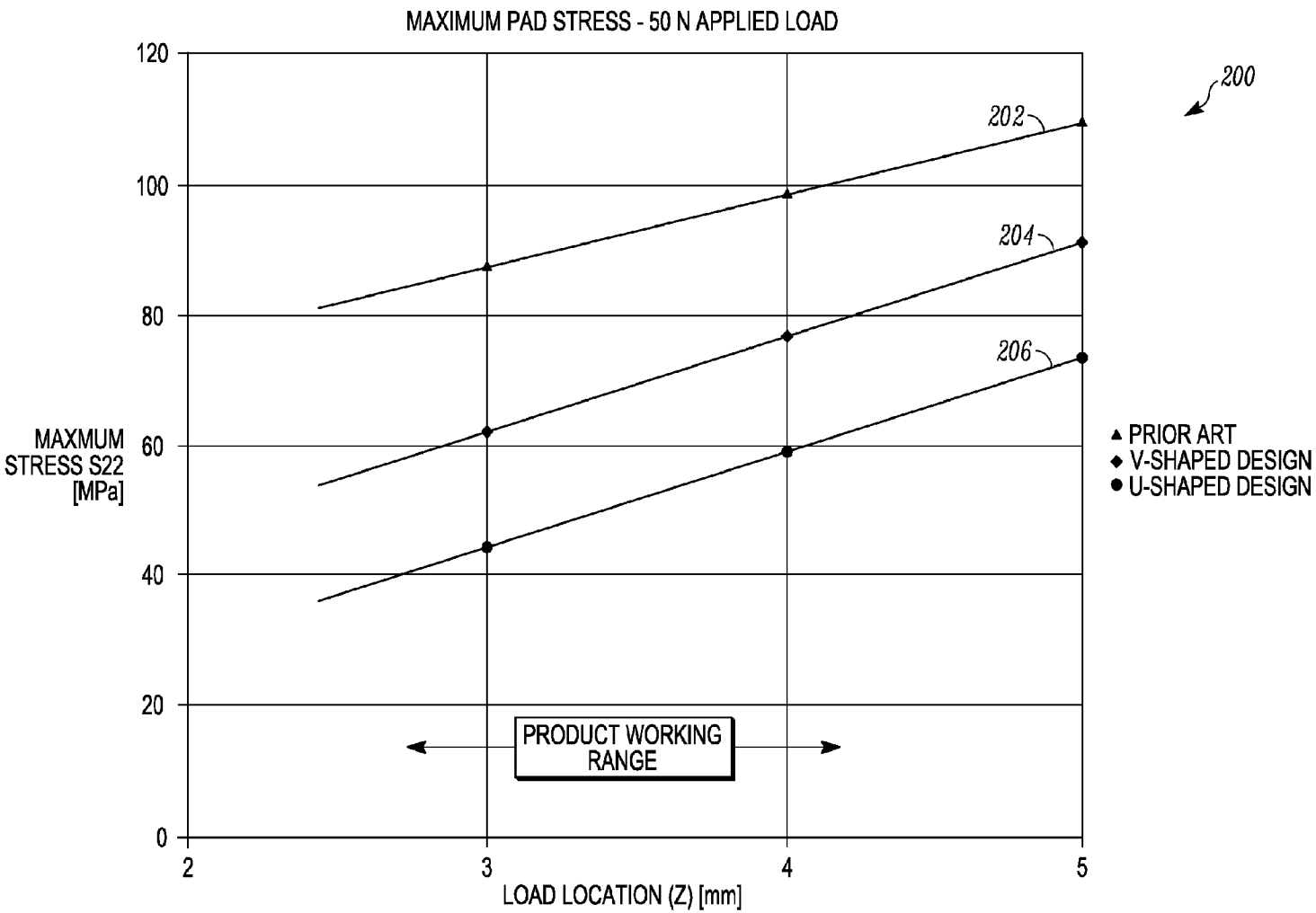
FIG. 10 shows simulated test results comparing the prior art configuration in FIGS. 1-4, and improved resilient plug connector 100 shown in FIGS. 5-8, in accordance with principles of the present invention.

Also advantageously, the connector 100 is adapted for simplified assembly and disconnection to a mating component, such as 12. The overall construction of the connector 100 is designed for improve strength of the part and enhanced impact resistance. The generally U-shaped contact 102 design effectively changes the pivot point of the structure during deformation and isolates stress away from the edge 134 of copper pad and distributes stress more evenly across a longer surface, as shown at simulated stress table 158 in FIG. 8. The cut out 130 construction in FIG. 7, for example, helps to provide an optimal reduction to stress along the third length 124 of horizontal leg 108 and allows the contact 102 to be captured in the retention block 110. Simulation results approach a 30% reduction in stress, as shown in FIG. 10, when compared to the prior art 10 having a cut out 24 at the bottom 26 (FIG. 4). The horizontal leg 108 is particularly adapted to being connected to a solder connection 118 (or pad), extending along the full length or third length 124 of a bottom surface 117 of contact 102.

Beneficially, electronic device, wireless communication device and mobile phone manufacturers, would welcome the benefits of having part engagement between a battery and a mating connector, with improved electrical connectivity even during drop/impact conditions. The resilient plug connector 100 significantly increase mechanical strength, reliability and durability of an electronic device. The U-shaped contact 102 design is an improvement in the prior art 10 design, because it increases the solderable area of the contact 100 along a bottom 117 of the horizontal leg 108.

In more detail, the first vertical leg 104 can include a first length 120 (FIG. 7) which is configured to facilitate interconnection with an electrical mating component, such as shown as 12 (FIGS. 1 and 3) at a certain height.

Figure 7:
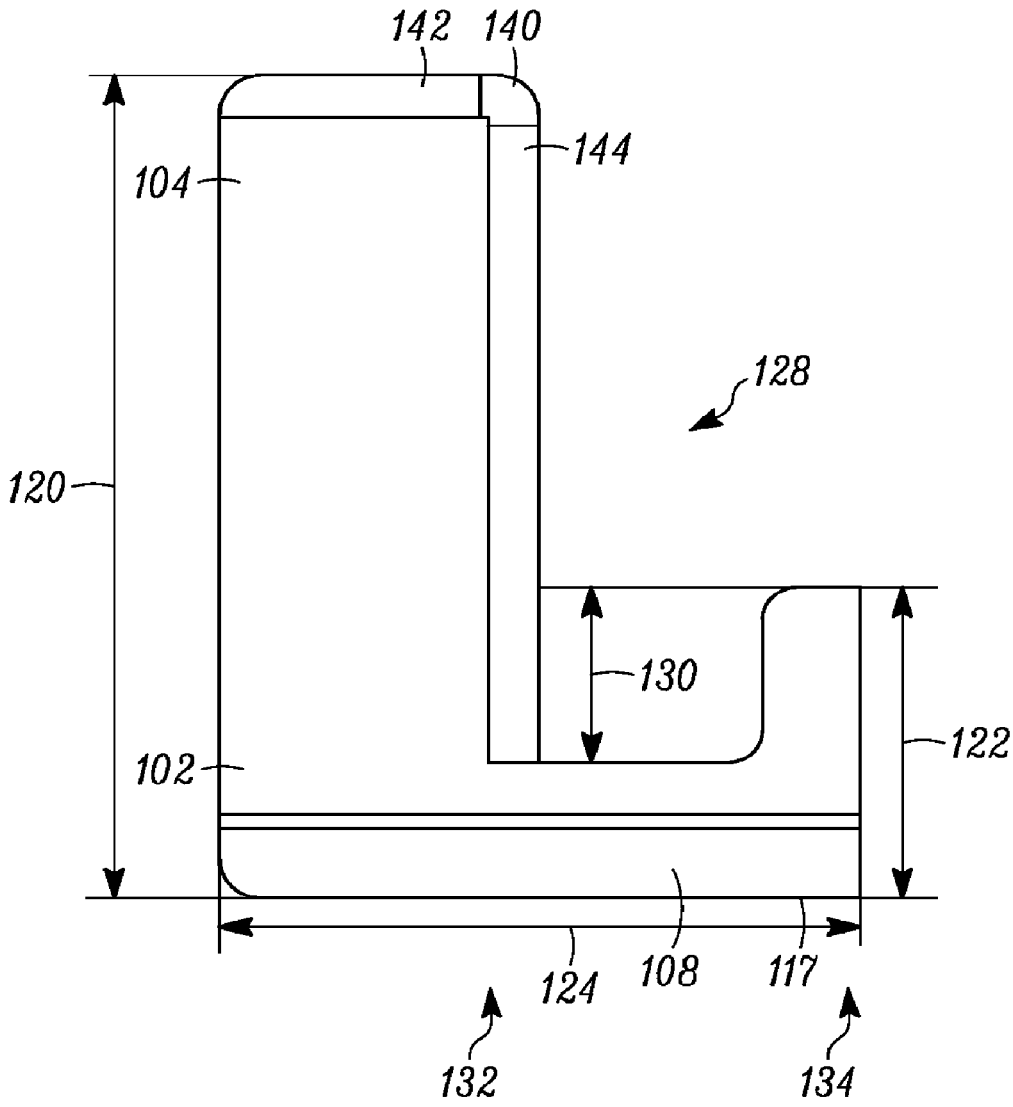
FIG. 7 is an enlarged side view of an embodiment of a resilient plug connector, showing the generally U-shaped contact 102 in FIG. 5, in accordance with principles of the present invention.

As shown in FIG. 7, the second vertical leg 106 includes a second length 122 which is less than a first length 120 of the first vertical leg 104. The second length 122 is chosen to minimize possible interference when interconnecting with an electrical mating component 12, for example.

Also as shown in FIG. 7, the horizontal leg 108 includes a third length 124 configured to provide a durable horizontal support. For example, the third length 124 is constructed sufficiently long to provide a secure anchor or extended area to spread and make stress more consistent in the event of an undesirable stress 126 along a z-axis.

In one embodiment, the first vertical leg 104, the second vertical leg 106 and the horizontal leg 108 define a generally U-shaped construction 128. Advantageously, a generally U-shaped construction 128 helps to provide an improved distribution of stress over a printed circuit board 116, minimizing the possibility of delamination and failure of the PCB 116. In more detail, the prior art blade 10 constructions 10 have experienced high failures. The failure occurred within PCB 20 layers as shown in FIG. 4, which cannot be reworked or repaired. Thus, the entire PCB 20 assembly was scrapped. Advantageously, ensuring good mechanical reliability of the resilient plug connector 100 can significantly save money for electronic manufacturing concerns. An U-shaped design is better than the prior art design because it increases the solderable area of the blade. Further, it is believed that providing a U-shaped construction 128 helps to shift the location of the peak stress towards the center of the solder connection 118 or pad and helps distribute the stress along the horizontal leg 108, thus minimizing the possibility of delamination or failure of the PCB 116. Yet further, it is believed that providing the U-shaped construction 128 additionally helps to reduce the peak stress, which helps to reduce the possibility of failure of the PCB 116. Continuing, it is also believed that as the channel depth 130 increases, the stress in the center 132 along the horizontal leg 108 increases and the stress at the edge 134 decreases, which helps to distribute the stress along the horizontal leg 108, thus minimizing the possibility of failure of the PCB 116. This will be discussed in further detail in connection with FIG. 10.

In one arrangement, the generally U-shaped contact 102 comprises a conductive material. For example, in one use case the contact 102 is adapted to electrically connect a battery 14 to a circuit on a printed circuit board 116, to provide power. A preferred conductive material includes brass or phosphor bronze for good conductivity.

Figure 8:
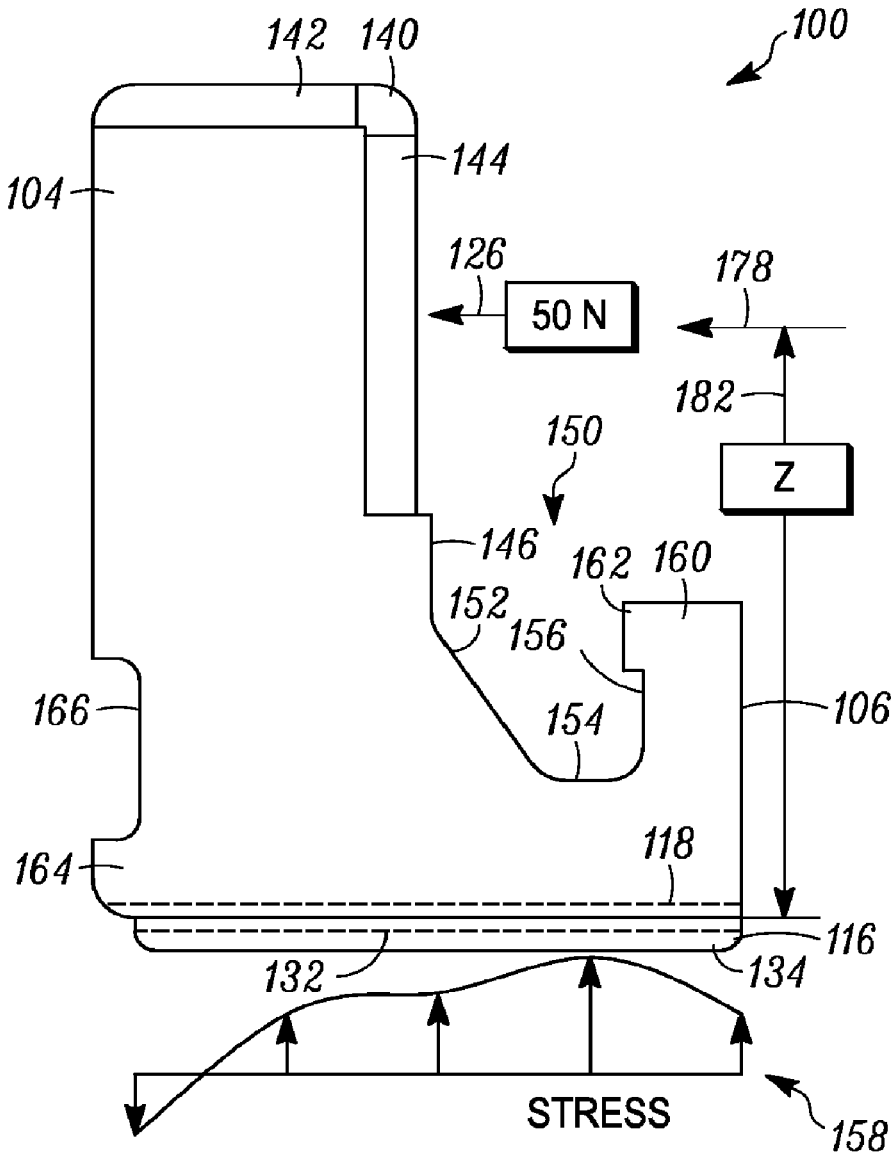
FIG. 8 is an enlarged side view of an embodiment of a resilient plug connector, showing the generally U-shaped contact 102 in FIG. 5 having a V-shaped cut out 150, in accordance with principles of the present invention.

As best shown in FIGS. 7 and 8, the first vertical leg 104 includes a chamfered portion 140 at an upper portion 142 and a side or inside portion 144. This structure can simplify and facilitate connection to a mating component 12 and to a battery 14, such as illustrated in FIG. 1. As shown in FIG. 8, the first vertical leg 104 can include a planar middle portion 146, for improved resilience and durability.

As best shown in FIGS. 7 and 8, the first vertical leg 104, the second vertical leg 106 and the horizontal leg 108 define a generally U-shaped construction 128 (FIG. 7) and more particularly a generally V-shaped construction 150 (FIG. 8), including an inclined section 152, a horizontal section 154 and a vertical section 156. This construction helps to provide an improved distribution of stress over the horizontal leg 108 and on the printed circuit board 116, minimizing the possibility of delamination to the PCB 116, as more fully detailed herein and as shown in the simulated stress table 158 in FIG. 8. As shown in FIG. 10, it is believed that further improvement can be realized by providing the generally V-shaped construction 150 and inclined section 152 to provide a more uniform stress along horizontal leg 108 and solder connection 118. As shown in table 158, the stress is more uniform, by decreasing the stress in the center 132 area and increasing the stress near the edge 134. The generally V-shaped construction 150 is a compromise, to help to provide a balance of providing a correct angle and channel depth, to evenly distribute the stress across a large area of the solder pad 118. This can help to minimize PCB failure and cracking of the solder pad or connection 118.

As best shown in FIG. 8, the second vertical leg 106 can include a distal section 160 extending inwardly 162. This construction can assist in providing an enhanced connection to the retention block 110. Likewise, the first vertical leg 104 can include a lower section 164 including an outwardly facing channel 166 to assist in providing an enhanced connection to the retention block 110. In more detail, the retention block 110 comprises a dielectric material comprising a polyglass filled plastic, for example. And the retention block 110 provides a support for at least one or preferably a plurality of contacts 102, as shown in FIG. 9.

Figure 9:
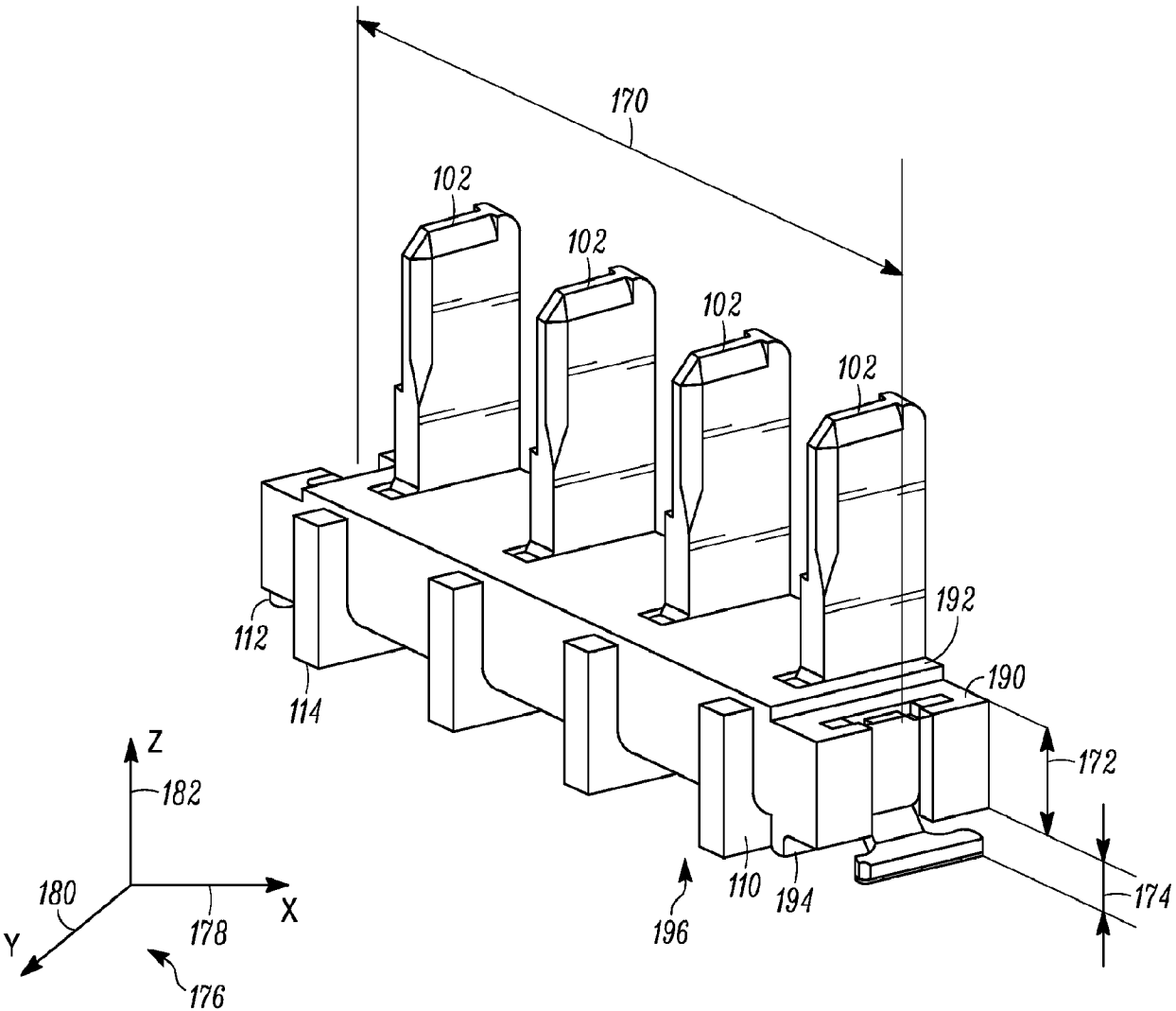
FIG. 9 is a perspective view of an embodiment of a resilient plug connector, showing a plurality of generally U-shaped contacts 102 shown configured in a retention block 110, in accordance with principles of the present invention.

As shown in FIG. 9, the retention block 110 comprises an elongated rectangular structure having a length 170 along an X-axis 178, a width 172 along a Y-axis 180 and a depth 174 along a Z-axis 182, and the first and second vertical legs 104 and 106, extend substantially along and are substantially parallel with the Z-axis 182. The retention block 110 provides a support for a plurality of contacts 102 which are easily mated to a mating component, such as 12, in a preferred embodiment. The plurality of generally U-shaped contacts 102 are adapted for a durable and robust connection with a mating structure. For example, the contacts 102 can connect a battery to a mating structure and a printed circuit board having a desired circuit, for providing power to a desired circuit, as should be understood by those skilled in the art. For example, four generally U-shaped contacts 102 are provided for connecting power to a desired circuit.

In yet more detail, the retention block 110 in FIG. 9 includes a substantially top planar surface 190 with an indentation area 192 immediately adjacent to each of the first vertical legs 104 and a substantially bottom planar surface 194 with a reservoir area 196 immediately adjacent to each of the horizontal legs. Advantageously, the indentation areas 192 and the reservoir areas 196 provide for a hollowed out area and simplified area for soldering of the horizontal leg 108 to a PCB 116, for improved resistance to undesirable peeling and delamination of a printed circuit board and an improved and larger solder connection 118.

Continuing, in a preferred embodiment in FIG. 9, the second vertical legs 106 extends outwardly along the Y-axis 180 and upwardly along the Z-axis 182 about at or below the top planar surface 190 of the retention block 110. Thus in this embodiment, the second vertical leg 106 at or below a top surface 190 minimizes the possibility of it interfering with the connection or disconnection with a mating component 12, when mating for example.

Referring to FIG. 10, the set out on the task of minimizing failures in connection with three cell phones with the prior art 10 construction detailed and shown in FIGS. 1-4. The failure occurred within PCB layers hence impossible to rework the part and potential ruin the entire PCB assembly. Simulated testing included applying a 50 N load in proximity to stress position 126, as shown in FIG. 8 along the y-axis 178.

The prior art device 10 results are shown at line 202, the U shaped in FIG. 7 is shown at line 204 and the U-shaped with V-cut (in FIG. 8) is shown at line 206. At the horizontal axis is maximum stress S22 (MPa). Along the horizontal axis is the load location or Z-axis height in FIG. 8. Lines 204 and 206 are a substantial improvement over the prior art 10.

It is believed that the U-shape design 102 in FIG. 7, shown at line 204, helps to shift the location of the peak stress towards the center of the solder pad and helps distribute the stress along horizontal leg 108 and solder connection 118, and reduce the peak stress. As the channel depth (or cut out 130) increases, the stress in the middle 132 increases and the stress at the edge 134 decreases. Further improvement was realized by creating a V-shaped cut out 150, in FIG. 8. It is believed that as the angle increases (inclined section 152) with respect to the Z-axis 182, a more uniform stress is gained as shown in stress table 158 in FIG. 8, and the stress in the center decreases and the stress at the edge increases, but is more uniform along horizontal leg 108 and solder connection 118. The V-shaped cut out 150 design, corresponding to line 206, was a compromise design created to balance the angle and channel depth to try to evenly distribute the stress across a large area and uniform area around horizontal leg 108 and the solder connection 118.

As should be understood, the resilient plug connector 10 is particularly adapted for use in connection with at least one of: a flip phone, slider phone, portable networking device, internet communications device, clamshell device, tablet device, radio telephone, cellular phone, mobile phone, smart phone, portable gaming device, personal digital assistant, wireless e-mail device, two-way pager, mobile computing device and handheld electronic device.

The resilient plug connector 10 is particularly adapted to be a compact size, such as with a narrow profile and to provide a secure, and reliable connection with any of the above devices and similar uses, as should be understood by those skilled in the art.

Further advantages of the resilient plug connector 10 are: superior capabilities, enhanced durability and performance, enhanced mating, improved reliability, light weight, portable, user friendly, easy to use, economical, and attractive.

Although embodiments of the invention have been shown and described, it is to be understood that various modifications, substitutions, and rearrangements of parts, components, and/or process steps, as well as other uses of the mobile electronic device can be made by those skilled in the art without departing from the novel spirit and scope of this invention.

What is claimed is:

1. A plug connector, comprising:

a generally U-shaped contact including a first vertical leg, a second vertical leg and a horizontal leg connecting the first vertical leg and the second vertical leg, the first vertical leg being longer than the second vertical leg, the horizontal leg including a bottom planar surface configured to provide a secure anchor in the event of an undesirable stress along a z-axis, the first vertical leg including a chamfered portion at a side portion facing the z-axis; and a retention block connected to a full length of the bottom planar surface of the horizontal leg configured to support the U-shaped contact.

2. The plug connector in accordance with claim 1 wherein the first vertical leg includes a first length which is configured to facilitate interconnection with an electrical mating component at a certain height.

3. The plug connector in accordance with claim 1 wherein the second vertical leg includes a second length which is less than a first length of the first vertical leg.

4. The plug connector in accordance with claim 1 wherein the horizontal leg includes a third length configured to provide a durable horizontal support.

5. The plug connector in accordance with claim 1 wherein the first vertical leg, the second vertical leg and the horizontal leg define a generally U-shaped construction.

6. The plug connector in accordance with claim 1 wherein the generally U-shaped contact comprises a conductive material.

7. The plug connector in accordance with claim 1 wherein the first vertical leg includes a chamfered portion at an upper portion.

8. The plug connector in accordance with claim 1 wherein the first vertical leg includes a planar middle portion.

9. The plug connector in accordance with claim 1 wherein the first vertical leg, the second vertical leg and the horizontal leg define a generally U-shaped construction including an inclined section, a horizontal section and a vertical section.

10. The plug connector in accordance with claim 1 wherein the second vertical leg includes a distal section extending inwardly.

11. The plug connector in accordance with claim 1 wherein the first vertical leg includes a lower section including an outwardly facing channel.

12. The plug connector in accordance with claim 1 the retention block comprises a dielectric material comprising polyglass filled plastic.

13. The plug connector in accordance with claim 1 the retention block comprises an elongated rectangular structure having a length along an X-axis, a width along a Y-axis and a depth along a Z-axis and the first and second vertical legs extend substantially along and are substantially parallel with the Z-axis.

14. The plug connector in accordance with claim 1 wherein the retention block comprises a plurality of generally U-shaped contacts.

15. The plug connector in accordance with claim 1 wherein the retention block comprises a plurality of generally U-shaped contacts, the retention block includes a substantially top planar surface with an indentation area immediately adjacent to each of the first vertical legs and a substantially bottom planar surface with a reservoir area immediately adjacent to each of the horizontal legs.

16. The plug connector in accordance with claim 1 wherein the second vertical leg extends outwardly along a Y-axis and upwardly along a Z-axis about at or below a top surface of the retention block.

17. A plug connector, comprising:

a plurality of generally U-shaped contacts each including a first vertical leg, a second vertical leg and a horizontal leg connecting the first vertical leg and the second vertical leg, the first vertical leg being longer than the second vertical leg, the horizontal leg including a bottom planar surface configured to provide a secure anchor in the event of an undesirable stress along a z-axis, the first vertical leg including a chamfered portion at a side portion facing the z-axis; and a retention block connected to a full length of the bottom planar surface of the horizontal leg configured to support each of the plurality of U-shaped contacts.

18. The plug connector in accordance with claim 17 wherein the retention block includes a substantially bottom planar surface with a reservoir area immediately adjacent to each of the horizontal legs, and the second vertical leg extends outwardly along a Y-axis and upwardly along a Z-axis about at or below a top surface of the retention block.

19. The plug connector in accordance with claim 17 wherein the first vertical leg, the second vertical leg and the horizontal leg define a generally U-shaped construction including an inclined section, a horizontal section and a vertical section.

* * * * *